United States Patent [19]

Sarcia

[11] 4,391,103

[45] Jul. 5, 1983

[54] FLUIDIC CRYOGENIC REFRIGERATOR

[75] Inventor: Domenico S. Sarcia, Carlisle, Mass.

[73] Assignee: CVI Incorporated, Columbus, Ohio

[21] Appl. No.: 369,865

[22] Filed: Apr. 19, 1982

[51] Int. Cl.[3] ..... F25B 9/00

[52] U.S. Cl. ..... 62/6; 60/520; 137/624.13; 137/625.35

[58] Field of Search ..... 62/6; 60/520; 137/624.13, 625.35

[56] References Cited

U.S. PATENT DOCUMENTS 2,966,035 12/1960 Gifford ..... 62/6
3,188,818 6/1965 Hogan ..... 62/6
3,188,821 6/1965 Chellis ..... 62/6
3,218,815 11/1965 Chellis et al. ..... 62/6
4,305,741 12/1981 Sarcia ..... 62/6

*Primary Examiner*—Ronald C. Capossela
*Attorney, Agent, or Firm*—Seidel, Gonda, Goldhammer & Panitch

[57] ABSTRACT

The cryogenic refrigerator includes a movable displacer within an enclosure having first and second chambers of variable volume. A refrigerant fluid is circulated in a fluid path between said chambers by movement of the displacer. A spool valve controls introduction of high pressure fluid and low pressure fluid. The displacer movement is controlled by fluidic pressure instead of an electric motor.

10 Claims, 3 Drawing Figures

FLUIDIC CRYOGENIC REFRIGERATOR

BACKGROUND

The present invention is an improvement on the Gifford-McMahon cycle. Familiarity with said cycle is assumed. Representative prior art patents teaching such cycle include U.S. Pat. Nos. 2,966,035; 3,188,818; 3,218,815; and 4,305,741.

In certain environments, such as a super conducting quantum interference device, the magnetic flux of an electric motor cannot be tolerated. Hence, there has been proposed a fluidic unit to cause movement of the displacer. For example, see U.S. Pat. No. 4,310,337. Fluidic refrigerators have certain disadvantages, namely lack of control of the displacers so that a full pressure charge of gas is introduced in each cycle and the objectional noise when the displacer bottoms out at the end of each stroke. The present invention solves those problems.

SUMMARY OF THE INVENTION

The present invention is directed to a cryogenic refrigerator in which a movable displacer defines within an enclosure first and second chambers of variable volume. A refrigerant fluid is circulated in a fluid flow path between the first chamber and the second chamber by movement of the displacer. Movement of the displacer is controlled in part through the introduction of high pressure fluid and the discharge of low pressure fluid.

The refrigerator includes chamber means for guiding a slide having an axial passage. The slide is connected to the displacer. A piston is connected to the slide for controlling movement of the displacer in response to gas at an intermediate pressure acting on the piston.

The passage in the slide has a restriction. A valve is provided with a spool valve member for controlling flow of the high and low pressure fluid. Means is provided including a conduit communicating one end of the spool valve member with the end of said chamber means remote from said displacer for introducing high fluid pressure into the conduit to shift the spool valve member when the displacer is at bottom dead center.

It is an object of the present invention to provide a fluidic cryogenic refrigerator wherein efficiency and reliability are improved by controlling movement of the displacer by a fluidic arrangement which acts as a dashpot during a stroke of the displacer and as a shock absorber at the ends of the stroke.

It is another object of the present invention to provide a fluidic cryogenic refrigerator which is simple and reliable.

Other objects and advantages will appear hereinafter.

For the purpose of illustrating the invention, there is provided in the drawing a form which is presently preferred; it being understood, however, that this invention is not limited to the precise arrangements and instrementalities shown.

DETAILED DESCRIPTION

Figure 1:
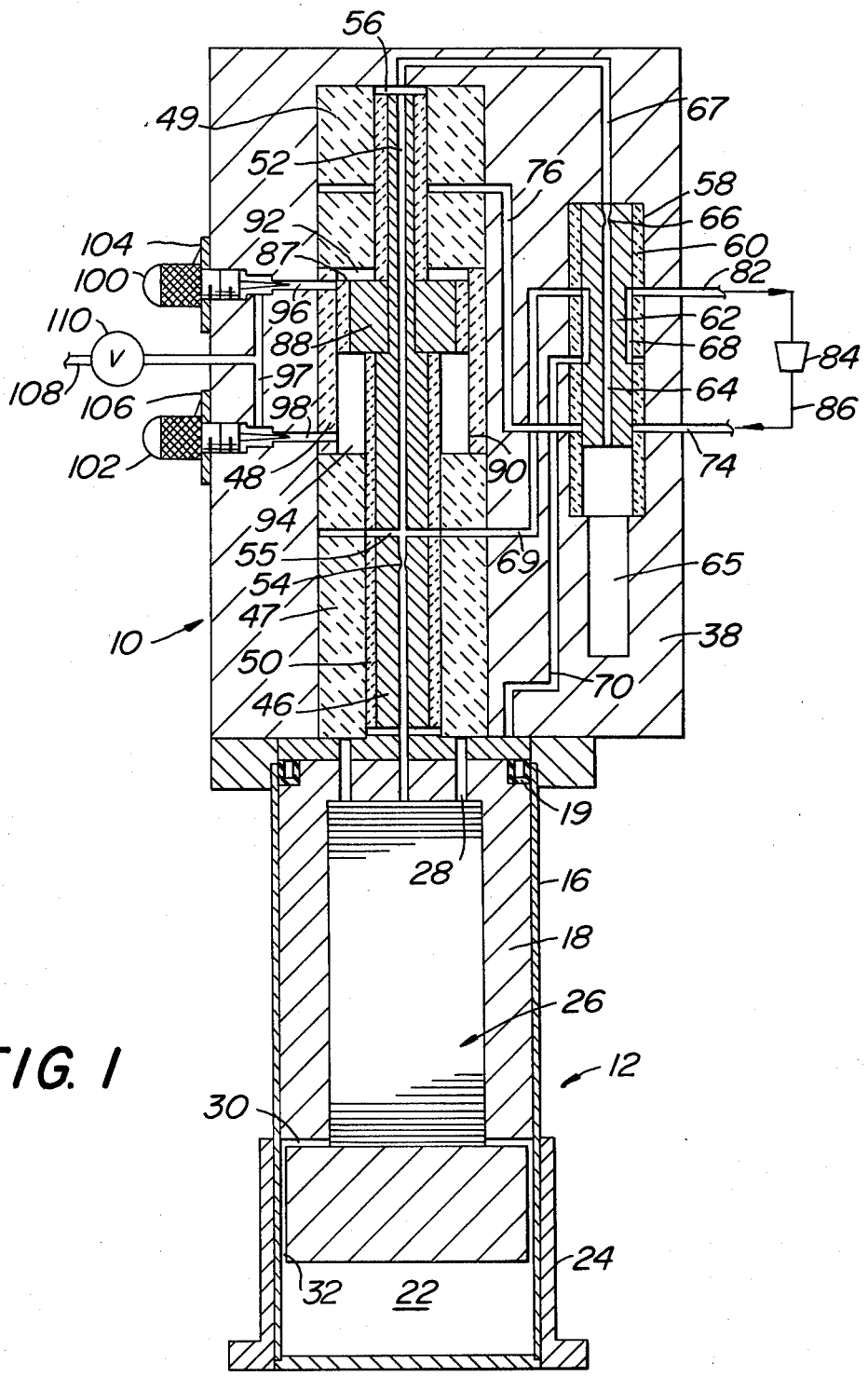
FIG. 1 is a vertical section view of a refrigerator in accordance with a first embodiment of the present invention with the displacer at top dead center position.

Referring to the drawings in detail, wherein like numerals indicate like elements, there is shown a refrigerator in accordance with the present invention designated generally as 10. As illustrated, the refrigerator 10 has a first stage 12 and may have a second stage. When in use said stages are disposed within a vacuum housing not shown. It is within the scope of the present invention to have one or more of such stages. Each stage includes a housing such as housing 16 within which is provided a displacer 18. A seal 19 is provided on displacer 18 for contact with housing 16. The displacer 18 has a length less than the length of the housing 16 so as to define a warm chamber 20 thereabove and a cold chamber 22 therebelow. The designations warm and cold are relative as is well known to those skilled in the art.

A heat station 24 in the form of a tube having a flanged ring and made from a good heat conductive material is attached to the housing 16 and surrounds the cold chamber 22. Heat station 24 may have other constructions as is well known to those skilled in the art.

Within the displacer 18, there is provided a regenerator 26 containing a matrix. Ports 28 communicate the upper end of the matrix in regenerator 26 with the warm chamber 20. See FIG. 2. Radially disposed ports 30 communicate the lower end of the matrix in regenerator 26 with a clearance space 32 disposed between the outer periphery of the lower end of the displacer 18 and the inner periphery of the housing 16. Thus, the lower end of the matrix in regenerator 26 communicates with the cold chamber 22 by way of ports 30 and clearance 32.

The matrix of the regenerator 26 is preferably a stack of 250 mesh material having high specific heat such as oxygen free copper. The matrix has low void area and low pressure drop. The matrix may be other materials such as lead spheres, nylon, glass, etc. A Slide 46 is connected to the upper end of the displacer 18. The slide 46 is surrounded by and guided by clearance seal sleeve bearings 47, 48 and 49 attached to the housing 38. Bearings 47, 48 and 49 are preferably made from a ceramic material. Slide 46 has cylindrical bearing inserts 50 in sliding contact with the inner periphery of the sleeve bearings 47, and 49. An axial flow passage 52 is provided in the slide 46. Slide 46 is no longer than the sleeve bearings and has radial ports 55 located above a restriction 54 in the passge 52. When the slide 46 is below top dead center, as shown in FIG. 2, the chamber means thereabove and within the bearing 49 is designated 56.

The housing 38 includes a bore 58 parallel to the slide 46. Within the bore 58 there is provided a clearance seal sleeve bearing 60 preferably made from a ceramic material. Within the sleeve bearing 60, there is provided a reciprocable spool valve member 62 having an axial flow passage 64. It will be noted that the member 62 has a length less than the length of the sleeve bearing 60 so that passage 64 communicates with chamber 65 therebelow.

Adjacent the upper end of member 62, there is provided a restriction 66 in passage 64. The upper end of the passage 64 communicates with chamber means 56 by way of conduit 67. A groove 68 is provided on the outer periphery of spool valve member 62. In the position of spool valve member 62 as shown in FIG. 1, one end of groove 68 communicates with the warm chamber 20 by way of passage 70. A high pressure port 74 is provided in housing 38 and is blocked by the spool valve member 62 in the position thereof as shown in FIG. 1. As will be made clear hereinafter, port 74 is adapted to communicate with chamber means 56 by way of passage 76 when the displacer 18 is at bottom dead center.

Figure 2:
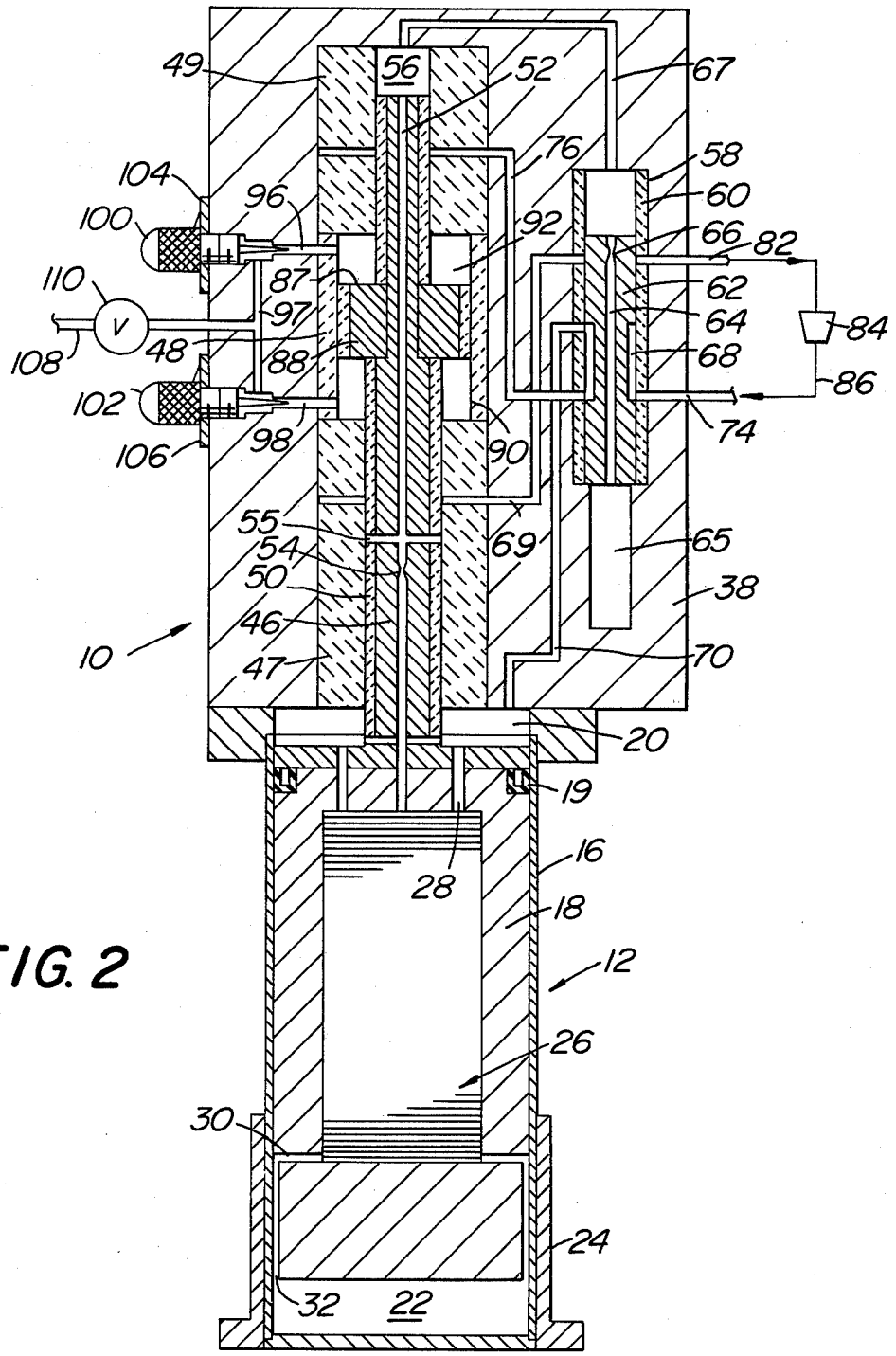
FIG. 2 is a view similar to FIG. 1 but showing the displacer at an intermediate position.

In the position of the spool valve member 62 as shown in FIG. 2, the upper end of the passage 69 is blocked by member 62. Port 55 of slide 46 communicates with passage 69 and groove 68 when slide 46 is at top dead center. See FIG. 1. Port 82 communicates with the suction side of a compressor 84. The output from compressor 84 communicates by way of conduit 86 with the high pressure port 74.

The housing 38 is constructed of a number of components so as to facilitate machining of the housing, assembly, and access to the spool valve member 62 and slide 46. The manner in which housing 38 is comprised of a plurality of components is not illustrated but will be obvious to those skilled in the art. The refrigerator 10 is preferably designed for use with a cryogenic fluid such as helium but other fluids such as air and nitrogen may be used. The refrigerator 10 was designed to have a wattage output of at least 65 watts at 77° K. and a minimum of 5 watts at 20° K.

Figure 3:
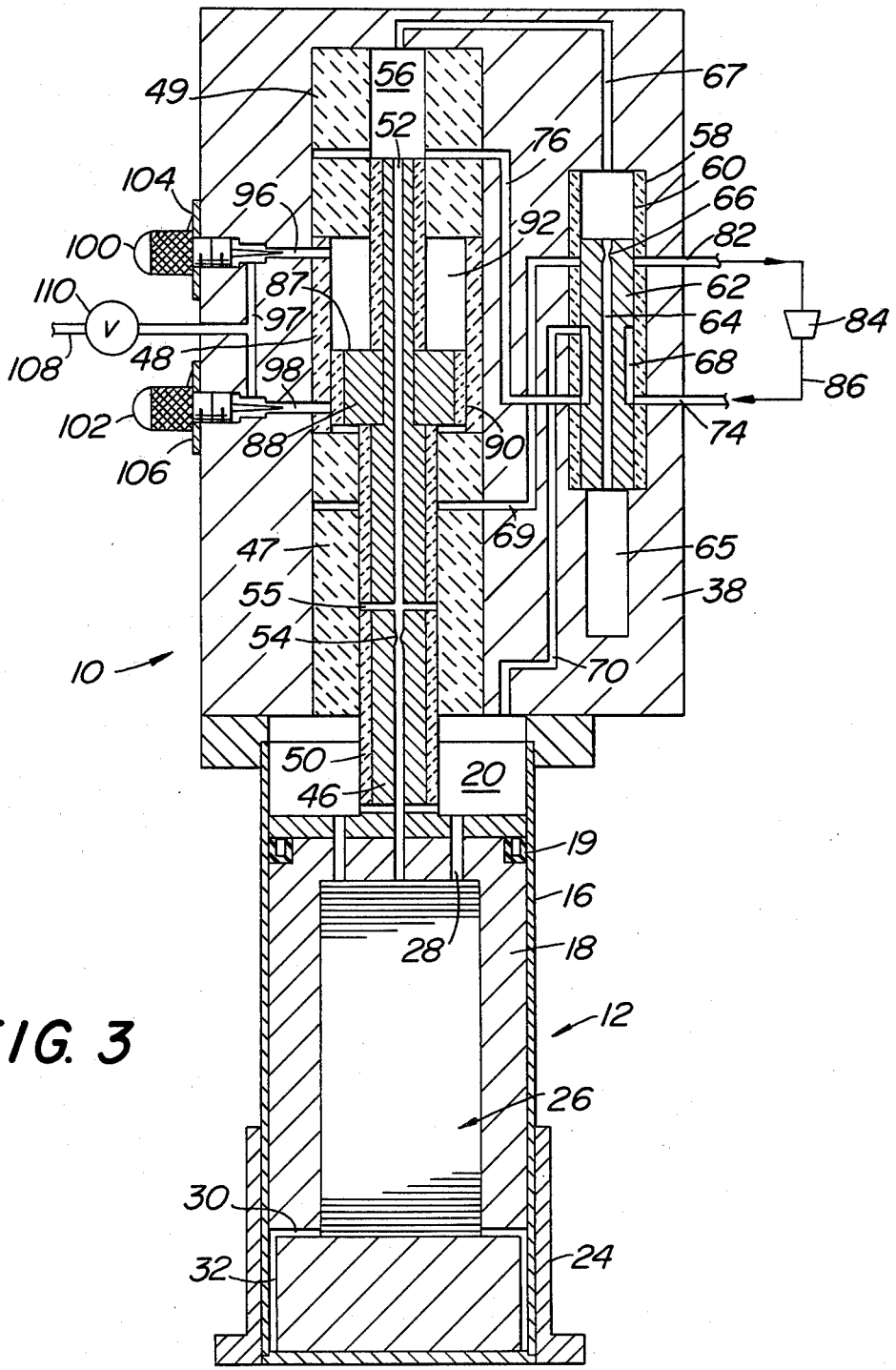
FIG. 3 is a view similar to FIG. 1 but showing the displacer at bottom dead center.

The upper end of slide 46 is smaller in diameter than the lower end. A piston 88 is attached to slide 46 and is supported by the larger diameter lower portion thereof. A differential reaction surface 87 is provided on piston 88. Piston 88 is disposed in chamber 90 defined by bearing 48. The space 92 above piston 88 is at a minimum when the displacer 18 is at top dead center as shown in FIG. 1 and at a maximum when the displacer 18 is at bottom dead center as shown in FIG. 3. The space below the piston 88 is designated 94.

Space 92 is in continual communication with space 94 by way of passages 96, 97, 98. A needle valve 100 controls flow between passages 96, 97. A needle valve 102 controls flow between passages 97, 98. Passage 96 communicates with space 92 at a location which traps gas between piston 88 and the upper end of chamber 90 to act as a shock absorber. The passage 98 communicates with space 94 in a similar manner.

The needle valves 100 and 102 are set at the same flow rate and have a valve member with a small taper such as 2°. A pointer is provided on valve member 100 for correlation with graduations on plate 104. A similar pointer is provided on valve member 102 for correlation with graduations on plate 106. The needle valves 100, 102 control the flow of gas between spaces 92, 94 and act as a dashpot. Hence, the cycles per minute may be varied by adjusting each valve by the same amount.

Passage 97 communicates with a source of intermediate pressure such as helium gas at 200 psi by way of conduit 108 containing valve 100. The specific amount of the intermediate pressure is relative to the high pressure at the output of compressor 84 which may be 300 psi and the low pressure at the input of compressor 84 which may be 100 psi.

OPERATION

As shown in FIG. 1, the displacer 18 is at top dead center. Spool valve member 62 has just moved to its uppermost position wherein chamber 20 communicates with the suction side of compressor 84 by way of passage 70, groove 68, and port 82. The chamber 65 below spool valve member 62 is also exhausted by way of passage 64, conduit 67, passage 52 and passage 69.

As the displacer begins to move donwwardly by differential pressure on piston surface 87, the cold low pressure gas in chamber 22 moves upwardly through the regenerator 26 and is exhausted. As the low pressure gas moves up through the regenerator 26, it absorbs heat from the regenerator thereby cooling the regenerator. As shown in FIG. 2, the displacer is moving down and toward bottom dead center. When the upper end of slide 46 uncovers passage 76, the displacer 18 will be at bottom dead center as shown in FIG. 3. Accuracy in locating the passage 76 directly effect efficiency. High pressure gas from port 74 now flows from passage 76 to chamber means 56 and conduit 67. Just before passage 76 is uncovered, piston 88 closes off passage 98 and traps gas at the intermediate pressure in space 94 therebelow. The trapped gas is compressed and absorbs the kinetic energy of displacer 18 thereby stopping the downward movement. The pressure between restrictors 54 and 66 increases. When the high pressure gas overcomes the low pressure fluid trapped in chamber 65, member 62 descends to the position shown in FIG. 2. Now the entire system except for passage 69 contains high pressure gas. The displacer 18 is at bottom dead center.

The function of the regenerator 26 is to cool the gas passing downwardly therethrough and to heat gas passing upwardly therethrough. In passage downwardly through the regenerator, the gas is cooled thereby causing the pressure to decrease and further gas to enter the system to maintain the maximum cycle pressure. The decrease in temperature of the gas in the chamber 22 is useful refrigeration which is sought to be attained by the apparatus at heat station 24. As the gas flows upwardly through the regenerator 26, it is heated by the matrix to near ambient temperature thereby cooling the matrix.

The side 46 is moved upwardly from bottom dead center as shown in FIG. 3 with the displacer 18 by differential pressure on piston 88 as high pressure gas moves downwardly into chambers 20, 22 and the void volume of regenerator 26. Port 55 communicates with passage 68 when cold volume is at maximum and just before top dead center is reached. This immediately places passage 52 and conduit 67 in communication with the suction side of the compressor 84. Piston 88 closes off passage 96 and traps gas at the intermediate pressure in space 92. The trapped gas is compressed and absorbs the kinetic energy of displacer 18 thereby stopping its upward movement.

The high pressure gas trapped in chamber 65 raises the spool valve member 62 from the position shown in FIG. 3 to the position shown in FIG. 1 as the displacer 18 reaches top dead center. One cycle is now complete. High pressure gas exhausts up through the regenerator 26 thereby cooling the matrix. A typical embodiment operates at the rate of 72–80 cycles per minute. The length of the stroke of the movable members is short such as 12 mm for valve member 62 and 30 mm for the displacer. Valve member 62 need not have axial flow passage 64 but instead may be a solid spool valve member which responds to differential pressure.

As piston 88 moves down with displacer 18, gas in space 94 flows to space 92 via passages, 98, 97 and 96. Also, gas from conduit 108 flows into space 92. As the piston 88 moves up, gas from space 92 flows into space 94 with part of the gas flowing into conduit 18 to the intermediate source. On the downstroke, the pressure on surface 87 at the intermediate pressure overcomes the opposing reaction of the low pressure gas. On the upstroke the high pressure gas overcomes the opposing reaction of the intermediate pressure gas on surface 87. The speed of the stroke in either direction will be the same so long as the needle valves 100, 102 are at the same position of adjustment.

The present invention may be embodied in other specific forms without departing from the spirit or essential attributes thereof and, accordingly, reference should be made to the appended claims, rather than to the foregoing specification, as indicating the scope of the invention.

I claim:

1. In a cryogenic refrigerator in which a movable displacer means defined within an enclosure first and second chambers of variable volume, and in which a refrigerant fluid is circulated in a fluid flow path between said first chamber and said second chamber by the movement of said displacer means controlled in part through the introduction of high-pressure fluid and the discharge of low-pressure fluid, chamber means for guiding a slide connected to the displacer means, said slide having an axial passage communicating with one end of said chamber means remote from the displacer means, a piston coupled to said slide for controlling movement of the displacer means, valve means for metering flow between opposite sides of said piston, the cross-section of said slide being smaller on one side of the piston than on the other side, said passage in said slide having a restriction, a valve having a spool valve member for controlling flow the high and low pressure fluid, means including a conduit communicating one end of said spool valve member with said one end of said chamber means for introducing high fluid pressure into the conduit to shift the spool valve member when the displacer means is at one of the extremities of its movement.

2. Apparatus in accordance with claim 1 wherein said valve means including a pair of spaced needle valves, a valved conduit communicating with each needle valve and adapted to communicate with a source of gas at an intermediate pressure.

3. Apparatus in accordance with claim 1 wherein said piston is arranged to trap fluid thereabove when the displacer means is at top dead center so that the trapped gas acts as a shock absorber.

4. Apparatus in accordance with claim 1 wherein said piston is arranged to trap fluid therebelow when the displacer means is at bottom dead center so that the trapped gas acts as a shock absorber.

5. Apparatus in accordance with claim 1 wherein said spool valve member has an axial passage containing a restriction therein adjacent the end thereof communicating with the conduit.

6. Apparatus in accordance with claim 2 wherein said needle valves are adjusted to the same flow rate.

7. Apparatus in accordance with claim 1 including a discrete ceramic clearance seal sleeve bearing for said slide, piston and spool valve member.

8. Apparatus in accordance with claim 1 including passage means for venting said passage in said slide and said conduit as the displacer means approaches top dead center to thereby enable the spool valve member to reverse its positions with respect to high and low pressure.

9. A cryogenic refrigerator comprising a movable displacer within an enclosure having first and second chambers of variable volume and in which a refrigerant fluid is circulated in a fluid flow path between said first chamber and said second chamber by the movement of said displacer controlled in part through the introduction of high-pressure fluid, chamber means for guiding a slide connected to the displacer, said slide having an axial passage communicating with one end of said chamber means remote from the displacer and said first chamber, a piston coupled to said slide intermediate its ends for controlling movement of the displacer, means for cycling gas at a metered rate between opposite faces of said piston when said displacer moves, said passage in said slide having a restriction, a valve having a spool valve member for controlling flow the high and low pressure fluid, means including a conduit communicating one end of said spool valve member with said one end of said chamber means for introducing high pressure fluid into the conduit to shift the spool valve member when the displacer is at bottom dead center, said spool valve member having an axial passage containing a restriction therein adjacent the end thereof communicating with the conduit.

10. Apparatus in accordance with claim 9 wherein said means for cycling gas includes first and second valved passages each communicating with one of the spaces on opposite sides of the piston at a location wherein it is blocked by the piston in a manner whereby gas will be trapped to absorb the kinetic energy of the displacer and stop the displacer at one end of its stroke.

* * * * *

UNITED STATES PATENT AND TRADEMARK OFFICE

CERTIFICATE OF CORRECTION

PATENT NO. : 4,391,103

DATED : July 5, 1983 Page 1 of 2

INVENTOR(S) : Domenico S. Sarcia

It is certified that error appears in the above—identified patent and that said Letters Patent is hereby corrected as shown below:

Figure 2 should appear as shown on the attached sheet. Column 2, line 66, cancel "FIG. 1" and insert --FIGS. 1 and 2--. Column 3, line 8, cancel "2" and insert --3--. Column 4, line 1, cancel "donwwardly" and insert --downwardly--; line 11, cancel "effect" and insert --effects--; line 21, cancel "to" and insert --from--; line 22, after "2", insert--to the position shown in FIG. 3--; line 37, cancel "side" and insert --slide --; line 42, cancel "68" and insert --69--; line 44, after "communication", insert --with the low pressure gas in passage 69 and when the spool valve member 62 shifts--; and line 66, cancel "18" and insert --108--. Claim 1, line 2, cancel "defined" and insert --defines--.

Signed and Sealed this

*Twenty-fifth* Day of *October 1983*

[SEAL]

*Attest:*

GERALD J. MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,391,103

DATED : July 5, 1983

INVENTOR(S) : Domenico S. Sarcia

It is certified that error appears in the above—identified patent and that said Letters Patent is hereby corrected as shown below:

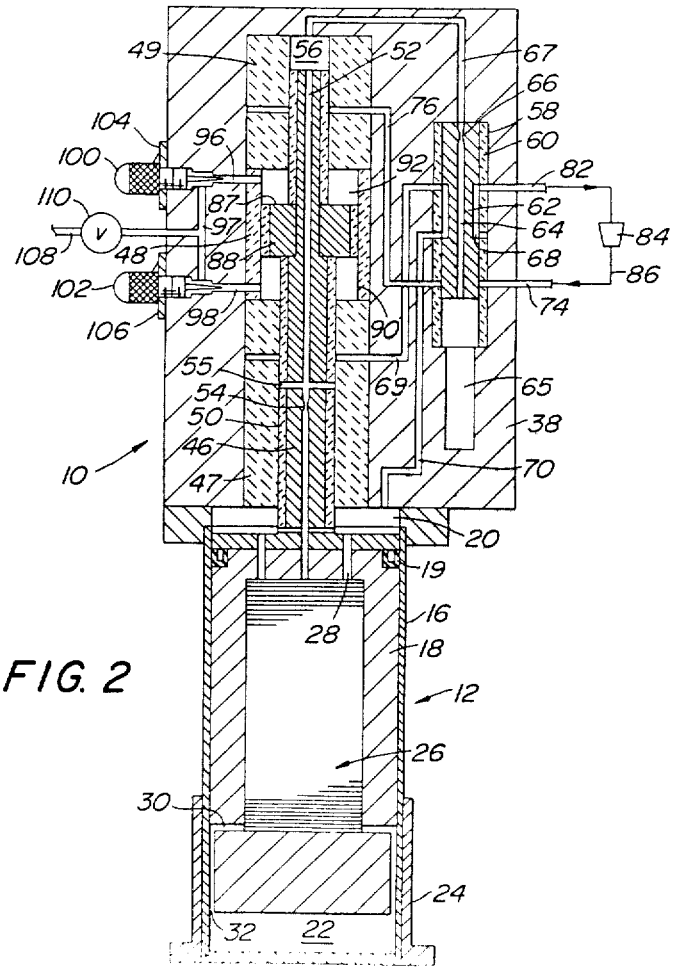

FIG. 2